US012275509B2

(12) United States Patent
Senoo et al.

(10) Patent No.: US 12,275,509 B2
(45) Date of Patent: Apr. 15, 2025

(54) FLUID MACHINE AND UNDERWATER VEHICLE

(71) Applicant: MITSUBISHI HEAVY INDUSTRIES, LTD., Tokyo (JP)

(72) Inventors: Shigeki Senoo, Tokyo (JP); Shinichi Isobe, Tokyo (JP); Wataru Yamada, Tokyo (JP); Takehiko Nishida, Tokyo (JP); Takuyoshi Yamada, Tokyo (JP); Kazuki Hosono, Tokyo (JP); Yoshitomo Noda, Tokyo (JP); Hiroki Takeda, Tokyo (JP); Yuichi Sekine, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 472 days.

(21) Appl. No.: 17/702,106

(22) Filed: Mar. 23, 2022

(65) Prior Publication Data

US 2022/0315184 A1 Oct. 6, 2022

(30) Foreign Application Priority Data

Mar. 31, 2021 (JP) ..... 2021-061822

(51) Int. Cl.
*B63H 1/28* (2006.01)
*B63G 8/08* (2006.01)
*B63H 21/17* (2006.01)

(52) U.S. Cl.
CPC ..... *B63H 1/28* (2013.01); *B63G 8/08* (2013.01); *B63H 21/17* (2013.01)

(58) Field of Classification Search
CPC . B63H 1/00; B63H 1/28; B63H 21/00; B63H 21/17; B63G 8/00; B63G 8/08
(Continued)

(56) References Cited

U.S. PATENT DOCUMENTS 3,531,214 A 9/1970 Abramson
5,286,116 A 2/1994 Garis, Jr.
(Continued)

FOREIGN PATENT DOCUMENTS

CN 211370815 8/2020
CN 112061357 12/2020
(Continued)

OTHER PUBLICATIONS

U.S. Office Action issued Oct. 26, 2022 in U.S. Appl. No. 17/825,451.
(Continued)

*Primary Examiner* — Lars A Olson
(74) *Attorney, Agent, or Firm* — Wenderoth, Lind & Ponack, L.L.P.

(57) ABSTRACT

A fluid machine includes: a shaft portion extending in an axis direction; a shroud provided to surround the shaft portion, and forming a flow path between the shroud and the shaft portion, the flow path having one side in the axis direction serving as an upstream side and another side in the axis direction serving as a downstream side; a first propeller provided rotatably around the axis between the shaft portion and the shroud; a second propeller provided rotatably around the axis between the shaft portion and the shroud on the downstream side of the first propeller; an outer periphery driving motor provided in the shroud and configured to rotationally drive the first propeller; and an inner periphery driving motor provided in the shaft portion and configured to rotationally drive the second propeller in a direction opposite to the rotational direction of the first propeller.

9 Claims, 5 Drawing Sheets

(58) Field of Classification Search
USPC ..... 114/338
See application file for complete search history.

(56) References Cited

U.S. PATENT DOCUMENTS

| | | | | |
|---|---|---|---|---|
| 5,289,068 | A * | 2/1994 | Veronesi | B63G 8/08 440/38 |
| 5,607,329 | A | 3/1997 | Cho et al. | |
| 5,795,076 | A | 8/1998 | Ball et al. | |
| 7,353,768 | B1 * | 4/2008 | Jones | B63G 8/08 114/337 |
| 8,074,592 | B2 | 12/2011 | Schröder | |
| 10,202,178 | B2 | 2/2019 | Himmelmann | |
| 10,414,477 | B2 | 9/2019 | Himmelmann | |
| 10,738,697 | B2 | 8/2020 | Himmelmann | |
| 11,152,555 | B2 | 10/2021 | Hiller | |
| 12,030,603 | B2 | 7/2024 | Lautrup et al. | |
| 2009/0293795 | A1 | 12/2009 | Schroder | |
| 2013/0115833 | A1 | 5/2013 | Suzuki et al. | |
| 2014/0356199 | A1 | 12/2014 | Varis et al. | |
| 2014/0368074 | A1 | 12/2014 | Tangudi | |
| 2017/0002857 | A1 | 1/2017 | Guest, Jr. | |
| 2017/0104385 | A1 | 4/2017 | Salamon et al. | |
| 2022/0315181 | A1 | 10/2022 | Senoo et al. | |
| 2022/0315183 | A1 | 10/2022 | Senoo et al. | |
| 2022/0315184 | A1 | 10/2022 | Senoo et al. | |
| 2022/0315185 | A1 | 10/2022 | Senoo et al. | |

FOREIGN PATENT DOCUMENTS

| | | |
|---|---|---|
| CN | 112874746 | 6/2021 |
| CN | 114056529 | 2/2022 |
| EP | 0425723 | 5/1991 |
| EP | 0566788 | 10/1993 |
| FR | 2927605 | 8/2009 |
| GB | 2593022 | 9/2021 |
| JP | 05-310185 | 11/1993 |
| JP | 5-310186 | 11/1993 |
| JP | 08-068599 | 3/1996 |
| JP | 10-257730 | 9/1998 |
| JP | 3346589 | 11/2002 |
| JP | 2004-168222 | 6/2004 |
| JP | 2013-100013 | 5/2013 |
| JP | 2017-109726 | 6/2017 |
| JP | 2018-519487 | 7/2018 |
| KR | 200477242 Y1 | 5/2015 |
| WO | 2004/113717 | 12/2004 |

OTHER PUBLICATIONS

U.S. Office Action issued Oct. 28, 2024 in U.S. Appl. No. 17/700,724.
U.S. Office Action issued Sep. 16, 2024 in U.S. Appl. No. 17/703,093.
Renilson, Martin; "Submarine Hydrodynamics", Springer International Publishing, 2015, ISSN 2191-5318, pp. 120-126.

* cited by examiner

FLUID MACHINE AND UNDERWATER VEHICLE

CROSS-REFERENCE TO RELATED APPLICATIONS

This application claims the benefit of priority to Japanese Patent Application Number 2021-061822 filed on Mar. 31, 2021. The entire contents of the above-identified application are hereby incorporated by reference.

TECHNICAL FIELD

The present disclosure relates to a fluid machine and an underwater vehicle.

RELATED ART

For example, an outer periphery driving propulsion apparatus is described in U.S. Pat. No. 8,074,592 as an example of a fluid machine. The propulsion apparatus includes a shroud having a tubular shape formed around the axis, and propellers coaxially arranged on the inner side of the shroud. Two propellers are arranged in the axis direction.

The shroud accommodates a total of two motors corresponding to the two respective propellers. Such two motors implement outer periphery driving of the two propellers, to make a fluid pumped in the axis direction inside the shroud. Note that in this propulsion apparatus, the two propellers are contra-rotating propellers with mutually opposite rotational directions.

SUMMARY

In the propulsion apparatus described in U.S. Pat. No. 8,074,592, a pair of motors of the contra-rotating propellers are accommodated in the shroud, and thus the accommodation space therefor needs to be ensured in the shroud. As a result, there is a problem in that the shroud is inevitably upsized.

The present disclosure is made to solve the problem described above, and an object of the present disclosure is to provide a fluid machine and an underwater vehicle with which downsizing of a shroud can be achieved.

In order to solve the above-described problem, a fluid machine according to the present disclosure includes: a shaft portion extending in an axis direction; a shroud provided to surround the shaft portion, and forming a flow path between the shroud and the shaft portion, the flow path having one side in the axis direction serving as an upstream side and another side in the axis direction serving as a downstream side; a first propeller provided rotatably around the axis between the shaft portion and the shroud; a second propeller provided rotatably around the axis between the shaft portion and the shroud on the downstream side of the first propeller; an outer periphery driving motor provided in the shroud and configured to rotationally drive one of the first propeller and the second propeller; and an inner periphery driving motor provided in the shaft portion and configured to rotationally drive another of the first propeller and the second propeller.

The present disclosure can provide a propulsion apparatus with which downsizing of a shroud can be achieved.

BRIEF DESCRIPTION OF DRAWINGS

The disclosure will be described with reference to the accompanying drawings, wherein like numbers reference like elements.

DESCRIPTION OF EMBODIMENTS

Overall Configuration of Underwater Vehicle

Figure 1:
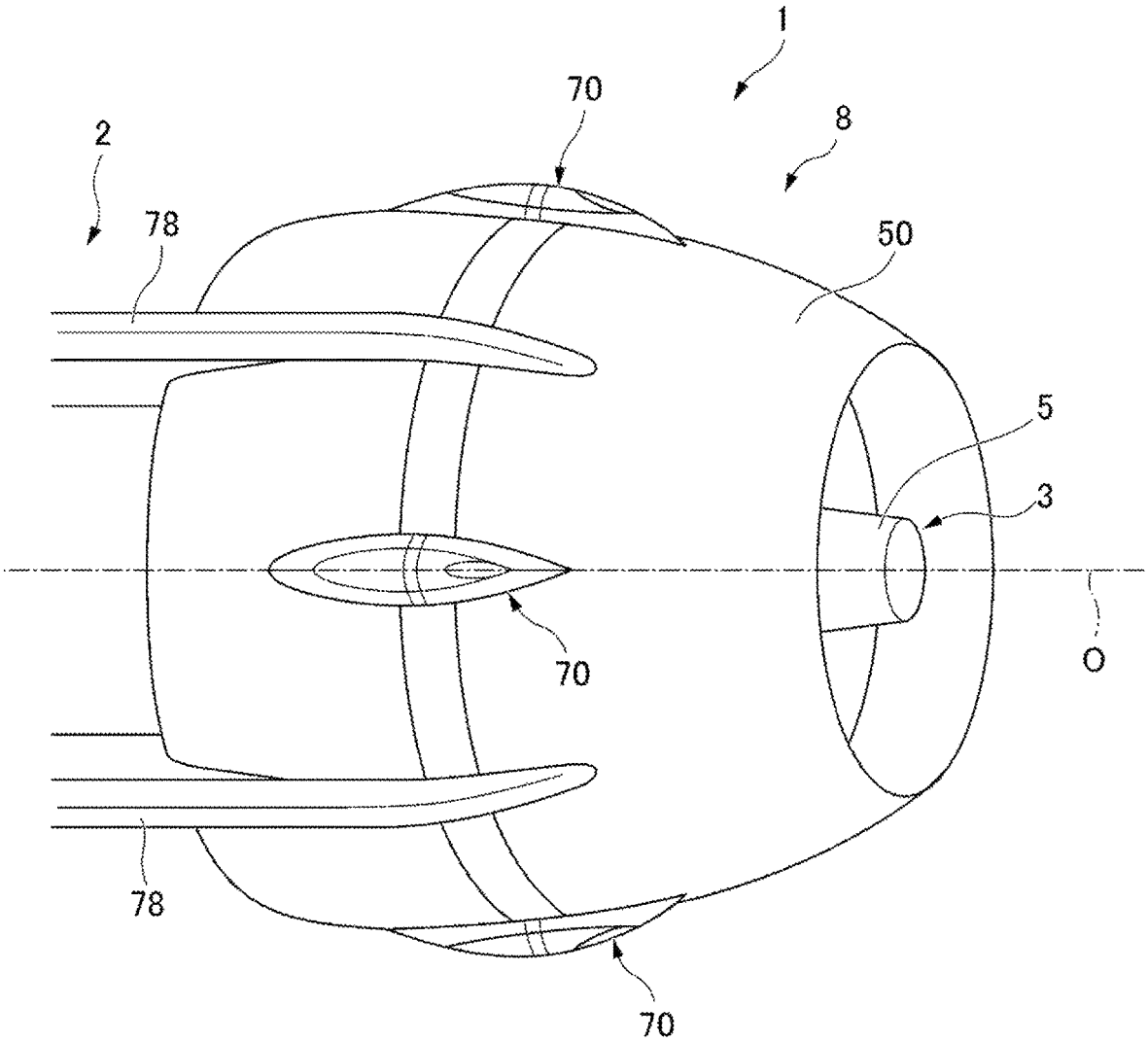
FIG. 1 is a perspective view of the stern of an underwater vehicle according to an embodiment of the present disclosure.
Figure 2:
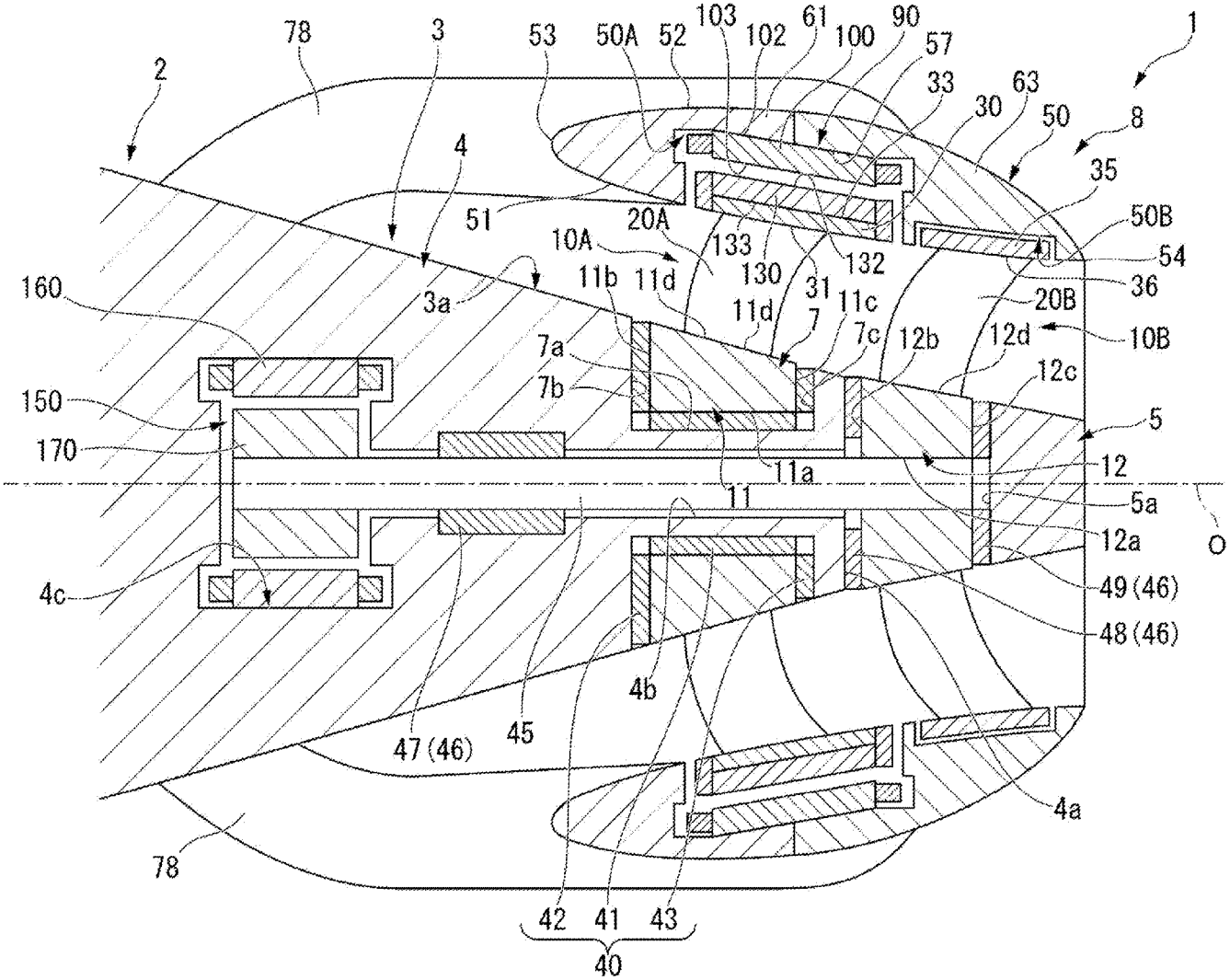
FIG. 2 is a vertical cross-sectional view of a propulsion apparatus according to the embodiment of the present disclosure.

The following describes in detail embodiments of the present disclosure, with reference to the drawings. As illustrated in FIG. 1 and FIG. 2, an underwater vehicle 1 includes a vehicle body 2 and a propulsion apparatus 8.

Vehicle Body

The vehicle body 2 is formed by a pressure-resistant container that extends along an axis O. The vehicle body 2 accommodates various devices, power supply, communication equipment, sensors, and the like required for cruising underwater, for example.

Propulsion Apparatus

In a rear portion of the vehicle body 2, the propulsion apparatus 8 is provided integrally with the vehicle body 2. The propulsion apparatus 8 is an apparatus for propelling the underwater vehicle 1 underwater.

The propulsion apparatus 8 includes a shaft portion 3, a first propeller 10A, a second propeller 10B, a first bearing portion 40, a rotor shaft 45, a second bearing portion 46, a shroud 50, coupling portions 70, struts 78, an outer periphery driving motor 90, and an inner periphery driving motor 150.

Shaft Portion

As illustrated in FIG. 2, the shaft portion 3 is integrally provided in the rear portion of the vehicle body 2. The shaft portion 3 may be part of the vehicle body 2. The shaft portion 3 extends along the axis O. The shaft portion 3 of the present embodiment has a truncated cone shape having a diameter decreasing from one side (hereinafter referred to as "upstream side") toward the other side (hereinafter referred to as "downstream side"), in the axis O direction. The radially outward facing surface of the shaft portion 3 is a shaft outside surface 3*a* forming a tapered shape having a diameter decreasing toward the downstream side.

The shaft portion 3 is split into a shaft front portion 4 on the upstream side and a shaft rear portion 5 on the downstream side. The shaft front portion 4 and the shaft rear portion 5 are disposed with a space therebetween in the axis O direction. The shaft rear portion 5 is the rearmost portion of the shaft portion 3 and has the smallest outside diameter.

The receiving groove 7 formed in the shaft front portion 4 of the shaft portion 3 is recessed inward in the radial direction from the shaft outside surface 3*a*, and annularly extends entirely over a circumferential direction. The receiving groove 7 is provided in a portion on the downstream side in the shaft front portion 4. A radially outward facing surface at the bottom of each receiving groove 7 is a groove bottom surface 7*a*. The groove bottom surface 7*a* forms a cylindrical surface shape around the axis O.

A surface, forming the receiving groove 7, on the upstream side is a groove upstream side surface 7*b*. The groove upstream side surface 7*b* has a planar shape orthogonal to the axis O, and faces the downstream side. The groove upstream side surface 7*b* annularly extends around the axis O.

A surface, forming the receiving groove 7, on the downstream side is a groove downstream side surface 7*c*. The groove downstream side surface 7*c* has a planar shape orthogonal to the axis O, and faces the upstream side. The groove downstream side surface 7*c* annularly extends around the axis O. The groove downstream side surface 7*c* is parallel to the groove upstream side surface 7*b*.

The rearmost end surface of the shaft front portion 4, that is, the end surface facing the downstream side is referred to as a rear end surface 4*a*. A hole portion 4*b* that opens to the rear end surface 4*a* and extends toward the upstream side is formed in the shaft front portion 4. The hole portion 4*b* extends from the rear end surface 4*a* to a portion on the upstream side of the receiving groove 7 along the axis O.

A motor accommodating space 4*c* formed inside the shaft front portion 4 is formed at an end portion of the hole portion 4*b* on the upstream side. The motor accommodating space 4*c* is formed as a hollow portion in the shaft front portion 4 so as to spread outward in the radial direction from the hole portion 4*b*.

A surface of the shaft rear portion 5 facing the upstream side is referred to as a front end surface 5*a*. The front end surface 5*a* is disposed at the rear end surface 4*a* of the shaft front portion 4 with a space therebetween in the axis O direction, and faces the rear end surface 4*a* in the axis O direction.

First Propeller and Second Propeller

As illustrated in FIG. 2, the first propeller 10A and the second propeller 10B are disposed to surround the axis O. The first propeller 10A and the second propeller 10B are relatively rotatable, around the axis O, with respect to the shaft portion 3.

First Propeller

The first propeller 10A includes a first inner circumference ring 11, a first blade 20A, and a first outer circumference ring 30.

The first inner circumference ring 11 is a member having a shape of a ring around the axis O. The first inner circumference ring 11 of the first propeller 10A is received in the receiving groove 7.

The first inner circumference ring 11 includes a first ring inner surface 11*a*, a first upstream end surface 11*b*, a first downstream end surface 11*c*, and a first outer circumference flow path surface 11*d*.

The first ring inner surface 11*a* forms an inside surface of the first inner circumference ring 11. The first ring inner surface 11*a* forms a cylindrical surface shape facing the groove bottom surface 7*a* entirely over the circumferential direction. The inside diameter of the first ring inner surface 11*a* is set to be greater than the outside diameter of the groove bottom surface 7*a*.

The first upstream end surface 11*b* is a surface of the first inner circumference ring 11 facing the upstream side, and is disposed on the downstream side of the groove upstream side surface 7*b* with a space therebetween.

The first downstream end surface 11*c* is a surface of the first inner circumference ring 11 facing the downstream side, and is disposed on the upstream side of the groove downstream side surface 7*c* with a space therebetween.

The first outer circumference flow path surface 11*d* forms an outside surface of the first inner circumference ring 11 facing outward in the radial direction, and the first outer circumference flow path surface 11*d* forms a tapered shape having a diameter decreasing toward the downstream side. The first outer circumference flow path surface 11*d* extends to be continuous with the shaft outside surface 3*a*.

The first blade 20A is provided to extend outward in the radial direction from the first outer circumference flow path surface 11*d* of the first inner circumference ring 11 of the first propeller 10A. A plurality of the first blades 20A are provided with a space therebetween in the circumferential direction. The dimension of the first blade 20A in the axis O direction is smaller than the dimension of the first inner circumference ring 11 in the axis O direction.

The cross-sectional shape of the first blade 20A intersecting in the radial direction is of a blade form. An edge portion of the first blade 20A on the upstream side is a leading edge. An edge portion of the first blade 20A on the downstream side is a trailing edge.

The first outer circumference ring 30 is a member forming the outer circumference portion of the first propeller 10A, and forms a shape of a ring around the axis O. The first outer circumference ring 30 establishes circumferential direction connection between the plurality of first blades 20A, arranged in the circumferential direction. The dimension of the first outer circumference ring 30 in the axis O direction is larger than the dimension of the first blade 20A in the axis O direction.

The first outer circumference ring 30 includes a first inner circumference flow path surface 31 and a tapered outer surface 33.

The first inner circumference flow path surface 31 is a surface forming the inside surface of each first outer circumference ring 30. The first inner circumference flow path surface 31 of the first outer circumference ring 30 of the first propeller 10A is integrally connected to end portions of the plurality of first blades 20A, arranged in the circumferential direction, outward in the radial direction.

The tapered outer surface 33 is a surface forming the outside surface of the first outer circumference ring 30. The tapered outer surface 33 forms a tapered shape having a diameter decreasing toward the downstream side. The tapered outer surface 33 has a uniform taper angle, and thus extends in the axis O direction with a uniform inclination angle relative to the axis O.

Second Propeller

The second propeller 10B includes a second inner circumference ring 12, a second blade 20B, and a second outer circumference ring 35.

The second inner circumference ring 12 is a member having a shape of a ring around the axis O. The second inner circumference ring is provided in a part of the shaft portion 3 between the shaft front portion 4 and the shaft rear portion 5 so as to be sandwiched between the shaft front portion 4 and the shaft rear portion 5 in the axis O direction.

The second inner circumference ring 12 includes a second ring inner surface 12*a*, a second upstream end surface 12*b*, a second downstream end surface 12*c*, and a second outer circumference flow path surface 12*d*.

The second ring inner surface 12*a* forms an inside surface of the second inner circumference ring 12. The second ring inner surface 12*a* forms a cylindrical surface shape facing the groove bottom surface 7*a* entirely over the circumferential direction.

The second upstream end surface 12*b* is a surface of the second inner circumference ring 12 facing the upstream side, and is disposed on the downstream side of the rear end surface 4*a* of the shaft front portion 4 with a space therebetween.

The second downstream end surface 12*c* is a surface of the second inner circumference ring 12 facing the downstream side, and is disposed on the upstream side of the front end surface 5*a* of the shaft rear portion 5 with a space therebetween.

The second outer circumference flow path surface 12*d* forms an outside surface of the second inner circumference ring 12 facing outward in the radial direction. The second outer circumference flow path surface 12*d* forms a tapered shape having a diameter decreasing toward the downstream side. The second outer circumference flow path surface 12*d* extends to be continuous with the shaft outside surface 3*a*.

The second blade 20B is provided to extend outward in the radial direction from the second outer circumference flow path surface 12*d* of the second inner circumference ring 12. A plurality of the second blades 20B are provided with a space therebetween in the circumferential direction. The dimension of the second blade 20B in the axis O direction is smaller than the dimension of the second inner circumference ring 12 in the axis O direction.

The cross-sectional shape of the second blade 20B intersecting in the radial direction is of a blade form. An edge portion of the second blade 20B on the upstream side is a leading edge. An edge portion of the second blade 20B on the downstream side is a trailing edge.

The second outer circumference ring 35 is a member forming the outer circumference portion of the second propeller 10B, and forms a shape of a ring around the axis O. The second outer circumference ring 35 establishes circumferential direction connection between the plurality of second blades 20B, arranged in the circumferential direction. The dimension of the second outer circumference ring 35 in the axis O direction is larger than the dimension of the second blade 20B in the axis O direction.

The inside surface of the second outer circumference ring 35 is a second inner circumference flow path surface 36. The second inner circumference flow path surface 36 is integrally connected to end portions of the plurality of second blades 20B, arranged in the circumferential direction, outward in the radial direction.

First Bearing Portion

The first bearing portion 40 supports the first propeller 10A to be rotatable relative to the shaft portion 3. The first bearing portion 40 is provided in the receiving groove 7 and rotatably supports the first inner circumference ring 11 of the first propeller 10A. The first bearing portion 40 includes a first radial bearing 41, a first upstream side thrust bearing 42, and a first downstream side thrust bearing 43.

The first radial bearing 41 is provided on the groove bottom surface 7*a* of the receiving groove 7 entirely over the circumferential direction. In the present embodiment, a journal bearing is used as the first radial bearing 41. A clearance is formed entirely over the circumferential direction between the first radial bearing 41 and the first ring inner surface 11*a* of the first inner circumference ring 11.

The first upstream side thrust bearing 42 is provided on the groove upstream side surface 7*b* of the receiving groove 7 entirely over the circumferential direction. The first upstream side thrust bearing 42 faces the first upstream end surface 11*b* of the first inner circumference ring 11 in the axis O direction, with the clearance in between.

The first downstream side thrust bearing 43 is provided on the groove downstream side surface 7*c* of the receiving groove 7 entirely over the circumferential direction. The first downstream side thrust bearing 43 faces the first downstream end surface 11*c* of the first inner circumference ring 11 in the axis O direction, with the clearance in between.

Water flowing into the receiving groove 7 is provided between the first radial bearing 41, the first upstream side thrust bearing 42, as well as the first downstream side thrust bearing 43 and the first inner circumference ring 11. Thus, the first radial bearing 41, the first upstream side thrust bearing 42, and the first downstream side thrust bearing 43 rotatably support the first inner circumference ring 11, with a water film formed between the bearings and the first inner circumference ring 11.

Rotor Shaft

The rotor shaft 45 extends along the axis O so as to be inserted in the hole portion 4*b* formed in the shaft front portion 4. A clearance is formed between the outside surface of the rotor shaft 45 and the inside surface of the hole portion 4*b*. The rotor shaft 45 is rotatable around the axis O. The rotor shaft 45 is provided so as to penetrate the first inner circumference ring 11 in the axis O direction inward in the radial direction of the first inner circumference ring 11. The end portion of the rotor shaft 45 on the upstream side is located within the motor accommodating space 4*c* in the shaft front portion 4. The end portion of the rotor shaft 45 on the downstream side protrudes toward the downstream side further from the hole portion 4*b*, and extends to the space between the shaft front portion 4 and the shaft rear portion 5. The end portion of the rotor shaft 45 on the downstream side is not in contact with the shaft rear portion 5.

Here, the second ring inner surface 12*a* of the second inner circumference ring 12 of the second propeller 10B is integrally fixed to the outside surface of the portion protruding toward the downstream side from the hole portion 4*b* in the rotor shaft 45. Thus, the rotor shaft 45 and the second propeller 10B rotate integrally around the axis O.

Second Bearing Portion

The second bearing portion 46 supports the second propeller 10B to be rotatable relative to the shaft portion 3. The second bearing portion 46 includes a second radial bearing 47, a second upstream side thrust bearing 48, and a second downstream side thrust bearing 49.

The second radial bearing 47 is provided in a portion on the upstream side of the first propeller 10A on the inside surface of the hole portion 4*b* of the shaft front portion 4, entirely over the circumferential direction. In the present embodiment, a journal bearing is used as the second radial bearing 47. The inside surface of the second radial bearing 47 rotatably supports the outside surface of the rotor shaft 45. In other words, the second radial bearing 47 rotatably supports the second propeller 10B via the rotor shaft 45.

The second upstream side thrust bearing 48 is provided on the rear end surface 4*a* of the shaft front portion 4, entirely over the circumferential direction. The second upstream side thrust bearing 48 faces the second upstream end surface 12*b* of the second inner circumference ring 12 in the axis O direction, with the clearance in between.

The second downstream side thrust bearing 49 is provided on the front end surface 5*a* of the shaft rear portion 5, entirely over the circumferential direction. The second downstream side thrust bearing 49 faces the second downstream end surface 12*c* of the second inner circumference ring 12 in the axis O direction, with the clearance in between.

Water is provided between the first upstream side thrust bearing 42 as well as the first downstream side thrust bearing 43 and the second inner circumference ring 12. Thus, the second upstream side thrust bearing 48 and the second downstream side thrust bearing 49 rotatably support the second inner circumference ring 12, with a water film formed between the bearings and the second inner circumference ring 12. Note that the second radial bearing 47 may also be configured to support the rotor shaft 45 with a water film therebetween.

Shroud

The shroud 50 is provided to surround the shaft portion 3, the first propeller 10A, and the second propeller 10B from the outer circumference side. The shroud 50 forms an annular shape around the axis O. The shroud 50 is disposed with a space from the shaft outside surface 3*a* of the shaft portion 3 in the radial direction. Thus, an annular flow path is formed entirely over the axis O direction between the shroud 50 and the shaft portion 3. The first blades 20A of the first propeller 10A and the second blades 20B of the second propeller 10B are positioned in the flow path, and the first outer circumference ring 30 of the first propeller 10A and the second outer circumference ring 35 of the second propeller 10B are accommodated in the shroud 50.

The surface of the shroud 50 facing inward in the radial direction is a shroud inside surface 51. The shroud inside surface 51 faces the flow path. The radially outward facing surface of the shroud 50 is a shroud outside surface 52.

The cross-sectional shape of the shroud 50 of the present embodiment, including the axis O, is of a blade form. A connection portion between end portions of the shroud inside surface 51 and the shroud outside surface 52 on the upstream side is a shroud leading edge 53 annularly extending entirely over the circumferential direction. A connection portion between end portions of the shroud inside surface 51 and the shroud outside surface 52 on the downstream side is a shroud trailing edge 54 extending entirely over the circumferential direction and forming an annular shape. The position of the shroud trailing edge 54 in the axis O direction is the same as the position of the rear end of the shaft portion 3, that is, the position of the rear end of the shaft rear portion 5, in the axis O direction.

The shroud 50 has a shape with the diameter gradually decreasing toward the downstream side from the upstream side. In the present embodiment, a camber line, in the blade form cross section of the shroud 50, distances to which from the shroud inside surface 51 and the shroud outside surface 52 are the same, is gradually inclined inward in the radial direction toward the downstream side from the upstream side. Thus, the shroud trailing edge 54 is positioned more inward than the shroud leading edge 53 in the radial direction.

The shroud outside surface 52 has a diameter first increasing toward the downstream side in a portion around the shroud leading edge 53, and then smoothly decreasing toward the downstream side. The shroud outside surface 52 forms a convex curved shape protruding toward outward in the radial direction.

The shroud inside surface 51 has a diameter decreasing inward in the radial direction toward the downstream side, entirely over the axis O direction. The shroud inside surface 51 forms a convex curved shape protruding toward inward in the radial direction. The annular flow path formed between the shroud inside surface 51 and the shaft outside surface 3*a* of the shaft portion 3 is narrowed inward in the radial direction toward the downstream side. Thus, the cross-sectional area of the flow path decreases toward the downstream side.

A cavity 50A and a receiving recess portion 50B that are recessed outward in the radial direction from the shroud inside surface 51 are formed in the shroud 50. The cavity 50A is formed in a portion on the upstream side in the shroud 50, whereas the receiving recess portion 50B is formed in a portion on the downstream side in the shroud 50. Thus, the receiving recess portion 50B is formed more on the downstream side than the cavity 50A.

The first outer circumference ring 30 of the first propeller 10A is accommodated in the cavity 50A. The second outer circumference ring 35 of the second propeller 10B is received in the receiving recess portion 50B.

The first inner circumference flow path surface 31 of the first outer circumference ring 30 of the first propeller 10A extends to be continuous with the shroud inside surface 51 in the axis O direction. In other words, the first inner circumference flow path surface 31 extends to form a part of the convex curved surface of the shroud inside surface 51.

The second inner circumference flow path surface 36 of the second outer circumference ring 35 of the second propeller 10B extends to be continuous with the shroud inside surface 51 in the axis O direction. In other words, the second inner circumference flow path surface 36 extends to form a part of the convex curved surface of the shroud inside surface 51.

On a surface in the cavity 50A facing inward in the radial direction, a tapered inner surface 57 having a bottom portion and having a diameter decreasing toward the downstream side with a uniform taper angle is formed. The tapered inner surface 57 is formed at a position in the axis O direction corresponding to the tapered outer surface 33 in the first outer circumference ring 30 of the first propeller 10A.

The shroud 50 of the present embodiment is formed by coupling a plurality of segments, split in the axis O direction. Specifically, the shroud 50 includes, as the segments, an upstream segment 61 and a downstream segment 63.

The upstream segment 61 forms a portion on the upstream side including the shroud leading edge 53.

The downstream segment 63 forms a portion that is continuous to the downstream side of the upstream segment 61, and forms a portion including the shroud trailing edge 54. The cavity 50A is defined and formed by both the upstream segment 61 and the downstream segment 63. The tapered inner surface 57 of the shroud 50 is formed across the upstream segment 61 and the downstream segment 63.

Coupling Portions

As illustrated in FIG. 1, the coupling portions 70 are provided to protrude from the shroud outside surface 52 of the shroud 50. The coupling portions 70 couple the plurality of segments of the shroud 50 to each other.

Figure 5:
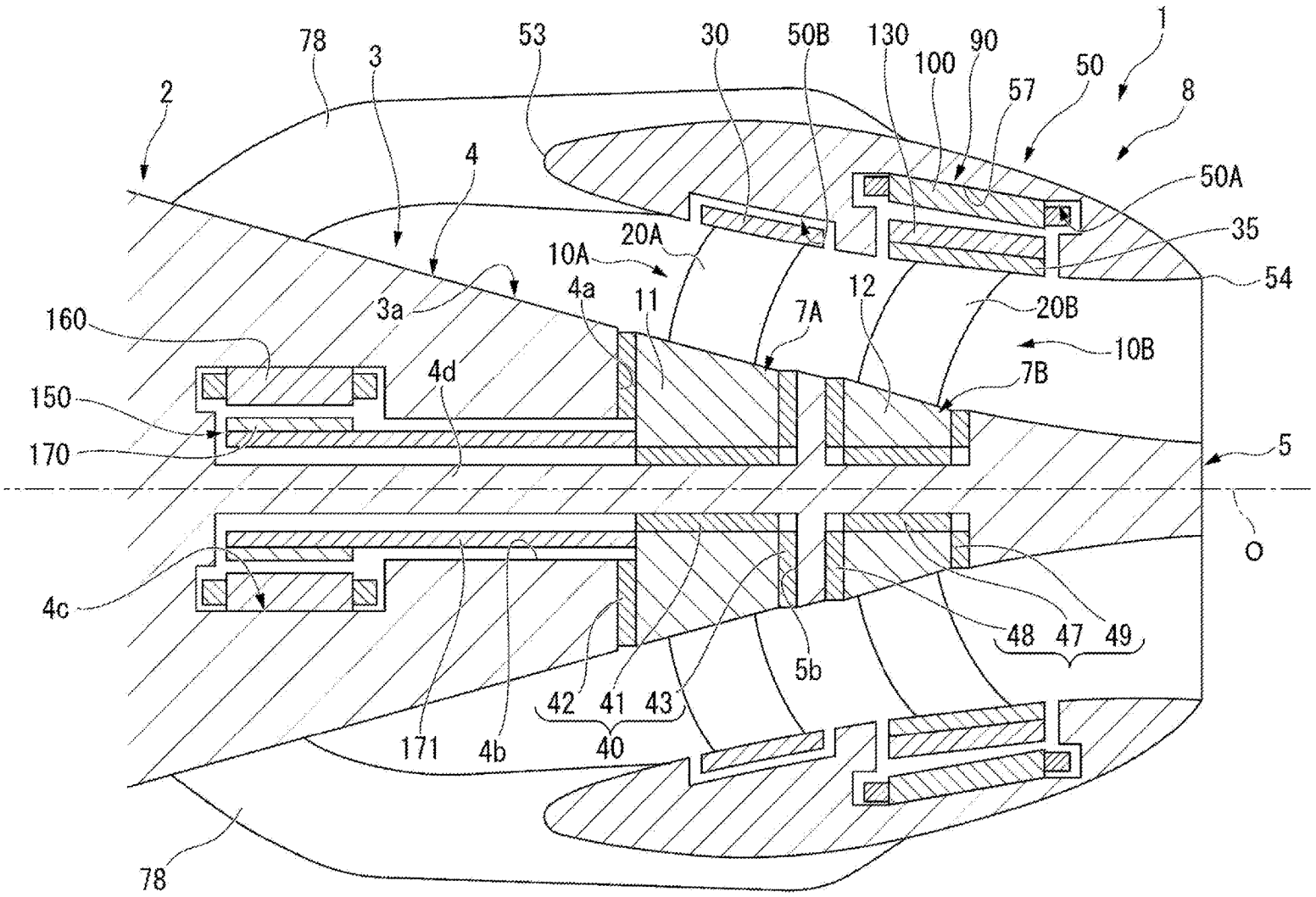
FIG. 5 is a vertical cross-sectional view of a propulsion apparatus according to a modification example of the embodiment of the present disclosure.

As illustrated in detail in FIG. 5, the coupling portions 70 each include an upstream protruding portion 71, a downstream protruding portion 73, a coupling bolt 74, and a filling portion 75.

Figure 3:
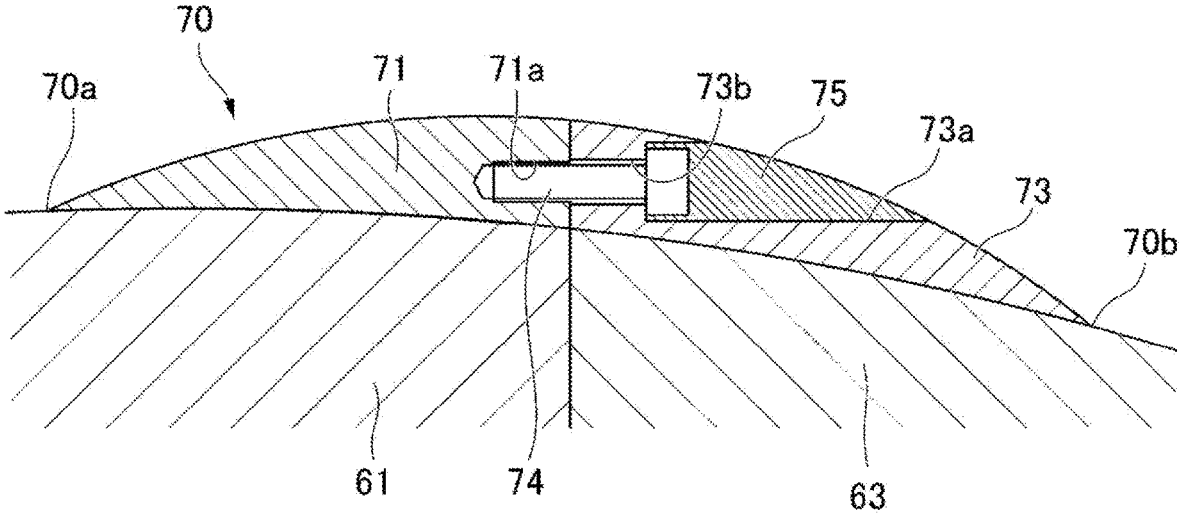
FIG. 3 is a vertical cross-sectional view of a coupling portion disposed on an outside surface of a shroud.

As illustrated in FIG. 3, the upstream protruding portion 71 is integrally provided to the upstream segment 61 of the shroud 50, and protrudes from the outside surface of the upstream segment 61. A bolt fix hole 71*a* is formed, in the upstream protruding portion 71, as a recess from the downstream side toward the upstream side.

The downstream protruding portion 73 is integrally provided to the downstream segment 63 of the shroud 50, and protrudes from the outside surface of the downstream segment 63. A bolt recess portion 73*a* is formed in the downstream protruding portion 73 as a recess from the downstream side toward the upstream side. A bolt insertion hole 73*b* is formed in the bottom portion of the bolt recess portion 73*a*, through the bottom portion and the surface of the downstream protruding portion 73 facing the upstream side.

The coupling bolt 74 couples the upstream protruding portion 71 and the downstream protruding portion 73 to each other. When the upstream segment 61 and the downstream segment 63 are coupled to each other by the coupling portion 70, the upstream protruding portion 71 and the downstream protruding portion 73 are positioned to come into contact with each other. In this state, the bolt insertion hole 73*b* and the bolt fix hole 71*a* are in communication with each other in the axis O direction. The coupling bolt 74 is inserted and fixed in the bolt insertion hole 73*b* and the bolt fix hole 71*a* thus in communication with each other, via the bolt recess portion 73*a*. As a result, the upstream protruding portion 71 and the downstream protruding portion 73 are integrally coupled to each other, and the upstream segment 61 integrated with the upstream protruding portion 71 and the downstream protruding portion 73 is integrally coupled in the axis O direction.

The filling portion 75 is provided to fill the bolt recess portion 73*a*. The filling portion 75 is cured resin for example. The filling portion 75 is formed when resin in a liquid form poured into the bolt recess portion 73*a* after the coupling bolt 74 is attached is cured. A part of the filling portion 75 forms the outer surface of the coupling portion 70.

Now the outer surface shape of the coupling portion 70 as described above will be described with reference to FIG. 3 and FIG. 4. The outer surface shape of the coupling portion 70 is formed by the upstream protruding portion 71 and the downstream protruding portion 73, as well as the surface of the filling portion 75 exposed from the bolt recess portion 73*a*. The coupling portion 70 as a whole forms a convex curved shape protruding from the shroud outside surface 52. The coupling portion 70 forms a convex curved shape with a longitudinal direction matching the axis O direction.

Figure 4:
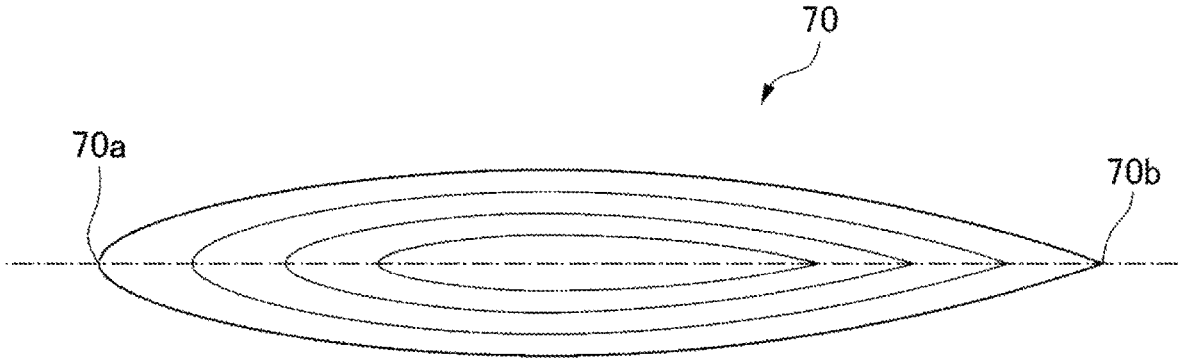
FIG. 4 is a schematic view of the coupling portion disposed on the outside surface of the shroud as viewed from outward in the radial direction.

Furthermore, as illustrated in FIG. 4, the coupling portion 70 of the present embodiment has a cross-sectional shape, along the shroud outside surface 52, being of a blade form with the upstream side corresponding to the leading edge and the downstream side corresponding to the trailing edge. The leading edge of the coupling portion 70 is a protruding portion leading edge 70*a*. The trailing edge of the coupling portion 70 is a protruding portion trailing edge 70*b*. More specifically, the coupling portion 70 has a shape obtained by stacking blade forms with similar shapes and sizes gradually decreasing as they get further in the normal direction of the shroud outside surface 52 in the normal direction.

Struts

As illustrated in FIG. 1 and FIG. 2, the struts 78 support the shroud 50 with respect to the shaft portion 3, by coupling the shroud 50 and the shaft portion 3 to each other. A plurality of the struts 78 are provided with a space therebetween in the circumferential direction, and extend in the axis O direction. The downstream side end portion of each strut 78 is fixed to the shroud 50. The upstream side end portion of the strut 78 is fixed to the shaft outside surface 3*a* of the shaft portion 3.

The cross-sectional shape of the strut 78 orthogonal to the axis O is a flat rectangular shape with the longitudinal direction matching the radial direction and the shorter direction matching the circumferential direction. Thus, the rotation of the propulsion of the underwater vehicle 1 is suppressed.

Note that in the present embodiment, the shaft portion 3 is split into the shaft front portion 4 and the shaft rear portion 5. Thus, the shaft rear portion 5 may be connected to the shroud 50 by a connection portion not illustrated, for example. As a result, the shaft front portion 4 and the shaft rear portion 5 are held coaxially.

Outer Periphery Driving Motor

The outer periphery driving motor 90 rotationally drives the first propeller 10A around the axis. As illustrated in FIG. 2, the outer periphery driving motor 90 is accommodated in the cavity 50A of the shroud 50. The outer periphery driving motor 90 rotationally drives the first propeller 10A. The outer periphery driving motor 90 is a conical motor having a conical stator 100 and a conical rotor 130.

Conical Stator

The conical stator 100 forms an annular shape around the axis O. The conical stator 100 forms a tapered shape having a diameter decreasing toward the downstream side. That is, a stator outside surface 102 that is the outside surface of the conical stator 100 and a stator inside surface 103 that is the inside surface of the conical stator 100 each form a tapered shape having a diameter decreasing toward the downstream side. The stator outside surface 102 and the stator inside surface 103 are parallel to each other in a cross-sectional view orthogonal to the axis O.

The taper angle of the stator outside surface 102 is the same as the taper angle of the tapered inner surface 57 within the cavity 50A of the shroud 50. Thus, the stator outside surface 102 is in contact with the tapered inner surface 57 entirely over the axis direction and the circumferential direction. Here, the stator outside surface 102 is fixed only to the downstream segment 63 out of the upstream segment 61 and the downstream segment 63 constituting the tapered inner surface 57. Thus, the stator outside surface 102 is integrally fixed to be unmovable with respect to the downstream segment 63, and is movable with respect to the upstream segment.

Conical Rotor

The conical rotor 130 is provided to the first outer circumference ring 30 of the first propeller 10A inward in the radial direction of the conical stator 100.

The conical rotor 130 forms an annular shape around the axis O. The conical rotor 130 forms a tapered shape having a diameter decreasing toward the downstream side. That is, a rotor outside surface 133 that is the outside surface of the conical rotor 130 and a rotor inside surface 132 that is the inside surface of the conical rotor 130 each form a tapered shape having a diameter decreasing toward the downstream side. The rotor outside surface 133 and the rotor inside surface 132 are parallel to each other in a cross-sectional view orthogonal to the axis O.

The taper angle of the rotor inside surface 132 is the same as the taper angle of the tapered outer surface 33 in the first outer circumference ring 30 of the first propeller 10A. Thus, the rotor inside surface 132 is in contact with the tapered outer surface 33 entirely over the axis direction and the circumferential direction and is integrally fixed. Thus, the conical rotor 130 and the first propeller 10A rotate integrally around the axis O.

Furthermore, the rotor outside surface 133 and the stator inside surface 103 face each other in the radial direction, and their taper angles are the same. Thus, a uniform clearance is formed in the axis O direction and the circumferential direction, between the rotor outside surface 133 and the stator inside surface 103.

In the outer periphery driving motor 90, when a coil provided in the conical stator 100 is energized, a rotating magnetic field is generated, and the conical rotor 130 rotates around the axis O due to this magnetic field.

Inner Periphery Driving Motor

The inner periphery driving motor 150 rotationally drives the second propeller 10B around the axis O. In the present embodiment, the inner periphery driving motor 150 rotationally drives the second propeller 10B via the rotor shaft 45. The inner periphery driving motor 150 is provided in the motor accommodating space 4*c* in the shaft portion 3. The inner periphery driving motor 150 includes a tubular stator 160 and a tubular rotor 170.

The tubular stator 160 forms a tubular shape around the axis O, and has the inside surface and the outside surface having a cylindrical surface shape parallel to the axis O. The tubular stator 160 is fixed to the inner wall surface of the motor accommodating space 4*c*.

The tubular rotor 170 forms a tubular shape around the axis O, and has the inside surface and the outside surface having a cylindrical surface shape parallel to the axis O. The tubular rotor 170 is disposed coaxially inward in the radial direction of the tubular stator 160. The outside surface of the tubular rotor 170 is disposed at the inside surface of the tubular stator 160 with a space therebetween. Thus, a uniform clearance is formed in the axis O direction and the circumferential direction, between the tubular stator 160 and the tubular rotor 170.

The inside surface of the tubular rotor 170 is integrally fixed to a portion of the outside surface of the rotor shaft 45 protruding from the hole portion 4*b* into the motor accommodating space 4*c*. Thus, the tubular rotor 170 and the rotor shaft 45 rotate integrally around the axis O.

In the inner periphery driving motor 150, when a coil provided in the tubular stator 160 is energized, a rotating magnetic field is generated, and the tubular rotor 170 rotates around the axis O due to this magnetic field. Note that the rotational direction of the inner periphery driving motor 150 is opposite to the rotational direction of the outer periphery driving motor 90.

Operational Effects

The underwater vehicle 1 having the configuration described above can cruise underwater, with the propulsion apparatus 8 driven. Specifically, when the outer periphery driving motor 90 is driven, the first propeller 10A integrally fixed to the conical rotor 130 rotates around the axis O, toward one side in the circumferential direction. As a result, the water is pumped toward the downstream side by the first blades 20A located in the flow path. In addition, when the inner periphery driving motor 150 is driven, the second propeller 10B integrally fixed to the tubular rotor 170 rotates around the axis O, toward the other side in the circumferential direction. As a result, the water is pumped toward the downstream side by the second blades 20B located in the flow path.

Then, thrust force toward the upstream side is generated at the first propeller 10A and the second propeller 10B, as a reaction force produced by the pumping of the water. The thrust force is transmitted to the shaft portion 3 via the first upstream side thrust bearing 42 and the second upstream side thrust bearing 48. As a result, the thrust force acts on the shaft portion 3 and the vehicle body 2 integrated therewith, whereby the underwater vehicle 1 is propelled.

As described above, according to the present embodiment, out of the pair of motors that rotate the first propeller 10A and the second propeller 10B, only the outer periphery driving motor 90 that rotationally drive the first propeller 10A is disposed in the shroud 50. The inner periphery driving motor 150 is configured to be disposed in the shaft portion 3. Thus, compared to a case where both the pair of motors are disposed in the shroud 50, the shroud 50 can be downsized.

In a case where both the motor driving the first propeller 10A and the motor driving the second propeller 10B are accommodated in the shroud 50, the shroud 50 is upsized in the axis O direction, and furthermore, the shape of the shroud 50 needs to be determined in accordance with the arrangement structures of the two motors. Thus, it might not be possible to make an optimal design that minimizes the drag against water.

In contrast, in the present embodiment, it is possible to downsize the shroud 50 and improve the degree of freedom of design by accommodating only one motor in the shroud 50. Thus, the shroud 50 can be designed such that the drag due to the shroud 50 against water is further suppressed, whereby the propulsion performance can be improved.

In addition, with the pumping of water by the first propeller 10A and the second propeller 10B, the flow of the water is narrowed inward in the radial direction toward the downstream side. Accordingly, the diameter of the flow path preferably decreases toward the downstream side. To form such a flow path, the shaft portion 3 forming the inside surface of the flow path needs to have a tapered shape having a diameter decreasing toward the downstream side.

Here, if the inner periphery driving motor 150 is installed inward in the radial direction of the second propeller 10B to rotationally drive the second propeller 10B in a direct manner, a sufficient installation space for the motor cannot be ensured because of the narrow rear end of the shaft portion 3. Ensuring the space despite the above-described fact leads to the upsizing of the shaft portion 3, and it is inevitable to employ a small motor having small output.

In contrast, in the present embodiment, the inner periphery driving motor 150 is installed in a portion on the upstream side of the first propeller 10A in the shaft portion 3, and is configured to rotate the second propeller via the rotor shaft 45 rotationally driven by the inner periphery driving motor 150. Thus, a sufficient installation space for the inner periphery driving motor 150 can be ensured. In addition, by installing the inner periphery driving motor 150 near a power source, it is possible to facilitate the routing of a power cable.

Furthermore, in the present embodiment, a structure of contra-rotating propellers is adopted in which the rotational directions of the first propeller 10A on the upstream side and the second propeller 10B on the downstream side are inverted. Thus, the swirling flow generated by the first propeller 10A serving as a water intake side can be collected by the second propeller 10B. Thus, the swirling loss at the slipstream of the second propeller 10B can be reduced, and the propulsion efficiency can be further improved.

Note that, since the contra-rotating propellers are employed in the present embodiment, the rotational directions of the first propeller 10A and the second propeller 10B are opposite to each other. Thus, it is necessary to provide separate motors for driving these.

In contrast, with the outer periphery driving motor 90 serving as the driving source for the first propeller 10A and the inner periphery driving motor 150 serving as the driving source for the second propeller 10B, the shroud 50 can be downsized.

Furthermore, in the present embodiment, the cross-sectional shape of the shroud 50 is of a blade form with the upstream side being the leading edge and the downstream side being the trailing edge, whereby drag in water can be minimized. Furthermore, the camber line of the blade form cross section of the shroud 50 is inclined inward in the radial direction toward the downstream side, whereby the shroud 50 as a whole, forming the blade form, has a tapered shape with the diameter decreasing toward the downstream side. Thus, the shape of the shroud 50 conforms to the flow direction of the water pumped, whereby the pump efficiency can be further improved.

In the present embodiment, the conical motor with the conical stator 100 and the conical rotor 130 each having a diameter decreasing toward the downstream side is employed as the outer periphery driving motor 90. Thus, the shape of the outer periphery driving motor 90 can be made in accordance with the shape of the shroud 50. Thus, the shape of the shroud 50 does not need to be upsized to conform to the configuration of the motor. This can make the shroud 50 have a further compact configuration.

When the first propeller 10A is rotating, a load is applied on the first propeller 10A itself toward the upstream side as a reaction force produced by pumping of a fluid. The load on the first propeller 10A is supported by the first upstream side thrust bearing 42.

When the outer periphery driving motor 90 as the conical motor is driven, electromagnetic force is generated in the conical rotor 130 outward in the radial direction, which is in the direction in which the conical rotor 130 and the conical stator 100 face, and toward the downstream side. Thus, on the conical rotor 130, force pulling it toward the downstream side acts as a component of the electromagnetic force. A part of the load acting on the first upstream side thrust bearing 42 from the first propeller 10A is canceled by the component. As a result, the load applied to the first upstream side thrust bearing 42 from the first propeller 10A can be reduced, that is, the thrust load produced by the first upstream side thrust bearing 42 can be reduced.

Furthermore, in the present embodiment, by decoupling the coupling portion 70 illustrated in FIG. 3, the shroud 50 can be separated into a plurality of segments (the upstream segment 61 and the downstream segment 63). Thus, the conical motor of the outer periphery driving motor 90 can be easily attached to the shroud 50 and the outer circumference ring of the first propeller 10A can be easily accommodated in the shroud 50.

As illustrated in FIG. 3 and FIG. 4, the coupling portion 70 has a convex curved shape protruding from the outside surface of the shroud 50, and the cross-sectional shape along the outside surface of the shroud 50 is of a blade form with the upstream side being the protruding portion leading edge 70*a* and the downstream side being the protruding portion trailing edge 70*b*. Thus, drag due to the coupling portion 70 while the underwater vehicle 1 is being propelled can be suppressed.

The conical stator 100 of the outer periphery driving motor 90 of the present embodiment is fixed only to the downstream segment 63, which is the segment on the downstream side, out of the upstream segment 61 and the downstream segment 63.

The force toward the downstream side, which is a component of the electromagnetic force, acts on the conical rotor 130 as described above, whereas the force toward the upstream side, which is a component of the electromagnetic force, acts on the conical stator 100, which is paired with the conical rotor 130. Thus, the force toward the upstream side also acts on the downstream segment 63, to which the conical stator 100 is integrally attached.

As a result, the downstream segment 63 is pressed against the upstream segment 61 by the force. Thus, the downstream segment 63 and the upstream segment 61 can be more rigidly fixed and integrated to each other. Furthermore, the fastening force of the coupling portion 70 coupling the upstream segment 61 and the downstream segment 63 can be relaxed. Accordingly, a fastening bolt with a smaller diameter can be used for the fastening portion, and the coupling portion 70 can be downsized, whereby the drag due to the coupling portion 70 against the flow of water can be further reduced.

OTHER EMBODIMENTS

The embodiment of the present disclosure has been described above, but the present disclosure is not limited thereto, and may be modified as appropriate within a range that does not deviate from the technical concept of the disclosure.

For example, in the embodiment, the motor that drives the first propeller 10A is configured to be the outer periphery driving motor 90, and the motor that drives the second propeller 10B is configured to be the inner periphery driving motor 150. However, this is not construed in a limiting sense. The motor that drives the first propeller 10A may be an inner periphery driving motor, and the motor that drives the second propeller 10B may be an outer periphery driving motor.

An example of this will be described as a modification example illustrated in FIG. 5. In FIG. 5, components similar to those in FIG. 2 are denoted by the same reference signs, and some of the reference signs are omitted.

Specifically, a first receiving groove 7A on the upstream side is formed between the shaft front portion 4 and the shaft rear portion 5 in the shaft portion 3, and a second receiving groove 7B on the downstream side is formed in the shaft rear portion 5. The hole portion 4*b* is formed as a recess from the rear end surface 4*a* of the shaft front portion 4 toward the upstream side, and the motor accommodating space 4*c* in the shaft front portion 4 is formed on the upstream side of the hole portion 4*b*. A center fix shaft 4*d* is provided in the hole portion 4*b* so as to pass through the motor accommodating space 4*c*, the hole portion 4*b*, and the first receiving groove 7A in the axis O direction. The center fix shaft 4*d* connects the shaft front portion 4 and the shaft rear portion 5 in the axis O direction.

The first receiving groove 7A is provided with the first bearing portion 40 including the first radial bearing 41 fixed to a center fix shaft 4*d*, the first upstream side thrust bearing 42 fixed to the rear end surface 4*a* of the shaft front portion 4, and the second upstream side thrust bearing 43 fixed to the front end surface of the shaft rear portion 5.

The second receiving groove 7B is provided with the second bearing portion including the second radial bearing 47, the second upstream side thrust bearing 48, and the second downstream side thrust bearing 49 fixed to the wall surface of the second receiving groove 7B.

The first inner circumference ring 11 of the first propeller 10A is provided rotatably around the axis O in the first receiving groove 7A, and the second inner circumference ring of the second propeller 10B is provided rotatably around the axis O in the second receiving groove 7B.

The receiving recess portion 50B is formed in a portion on the upstream side in the shroud 50, whereas the cavity 50A is formed in a portion on the downstream side of the receiving recess portion 50B. The outer circumference ring 30 of the first propeller 10A on the upstream side is received in the receiving recess portion 50B. The outer circumference ring 35 of the second propeller 10B on the downstream side is formed on the cavity 50A. The conical stator 100 of the outer periphery driving motor 90 accommodated in the cavity 50A is attached to the outer circumference ring 35 of the second propeller 10B. In this manner, the outer periphery driving of the second propeller 10B on the downstream side is implemented in the modification example.

The inner periphery driving motor 150 is provided in the motor accommodating space 4*c* in the shaft front portion 4. The inner periphery driving motor 150 includes the tubular rotor 170 provided to surround the center fix shaft 4*d*, and the tubular stator 160 surrounding the tubular rotor 170 from the further outer circumference side and fixed to the shaft front portion 4. Furthermore, a tubular rotor shaft 171 is provided between the inside surface of the hole portion 4B in the shaft front portion 4 and the outside surface of the center fix shaft 4*d*. The tubular rotor shaft 171 extends in a tubular shape coaxially with these surfaces and with a space therebetween in the radial direction. A portion of the tubular rotor shaft 171 on the upstream side is integrally fixed to the inside surface of the tubular rotor 170. An end portion of the tubular rotor shaft 171 on the downstream side is integrally fixed to the first inner circumference ring 11 of the first propeller 10A. As the tubular rotor 170 of the inner periphery driving motor 150 is rotated, the first inner circumference ring 11 rotates via the tubular rotor shaft 171. In this manner, the inner periphery driving of the first propeller 10A on the upstream side is implemented in the modification example.

As described above, in the modification example in which the inner periphery driving of the first propeller 10A and the outer periphery driving of the second propeller 10B are implemented, the length of the shaft connecting the inner periphery driving motor 150 and the propeller can be shortened compared to the embodiment. Specifically, compared to the rotor shaft 45 for the inner periphery driving of the second propeller 10B in the embodiment, the length in the axis O direction of the tubular rotor shaft 171 that rotationally drives the first propeller 10A in the modification example can be shortened. Thus, the stability of the shaft can be improved.

Note that the center fix shaft 4*d* and the tubular rotor shaft need to be provided separately in the first modification example, whereas it suffices if only the rotor shaft 45 is provided in the embodiment, which is advantageous in that the number of components is kept small. That is, in the embodiment in which the outer periphery driving of the first propeller 10A and the inner periphery driving of the second propeller 10B are implemented, the overall configuration can be simple compared to the modification example.

While the inner periphery driving motor 150 is configured to rotationally drive the second propeller 10B via the rotor shaft 45 in the embodiment, the inner periphery driving motor 150 may be configured to directly rotate the second propeller 10B. In this case, the inner periphery driving motor 150 is provided inward in the radial direction of the second inner circumference ring 12 of the second propeller 10B.

While the outer periphery driving motor 90 is a conical motor in the embodiment, the outer periphery driving motor 90 may be a tubular motor similar to the inner periphery driving motor 150. Furthermore, the inner periphery driving motor 150 may be a conical motor similar to the outer periphery driving motor 90. In particular, in a case where the inner periphery driving motor 150 is provided at the rear of the tapered shaft portion 3, the use of a conical motor is preferable.

That is, any motor may be employed as the outer periphery driving motor 90 and the inner periphery driving motor 150.

In the embodiment, an example is described in which the cross-sectional shape of the shroud 50 is of a blade form. However, the blade form should not be construed in a limiting sense. The cross-sectional shape of the shroud 50 is preferably a streamline shape, but may be other shapes such as a rectangular shape, for example. Also in this case, with the shroud 50 having the diameter decreasing toward the downstream side, a flow path with a flow path cross-sectional area decreasing toward the downstream side is defined and formed.

In the embodiment, an example is described in which the shroud 50 is split into two segments, in accordance with the number of motors. However, the present disclosure is not limited to this, and a configuration may be employed in which the shroud 50 is split into three in the axis O direction.

Furthermore, in the embodiment, an example is described in which the fluid machine according to the present disclosure is applied to the propulsion apparatus 8 of the underwater vehicle 1. However, the present disclosure is not limited to this, and for example, the fluid machine may be applied to the propulsion apparatus 8 of a ship or the like that cruises on water.

The fluid machine according to the present disclosure is not limited to the propulsion apparatus 8, and may be applied to other fluid machines used underwater such as a pump. Furthermore, the present disclosure is not limited to a fluid machine that pumps water, and may be applied to a fluid machine that pumps other types of liquid such as oil.

Notes

The propulsion apparatus 8 (fluid machine) and the underwater vehicle 1 described in each of the embodiments are construed as follows, for example.

(1) A fluid machine according to a first aspect includes: a shaft portion 3 extending in an axis O direction; a shroud 50 provided to surround the shaft portion 3, and forming a flow path between the shroud 50 and the shaft portion 3, the flow path having one side in the axis O direction serving as an upstream side and another side in the axis O direction serving as a downstream side; a first propeller 10A provided rotatably around the axis O between the shaft portion 3 and the shroud 50; a second propeller 10B provided rotatably around the axis O between the shaft portion 3 and the shroud 50 on the downstream side of the first propeller 10A; an outer periphery driving motor 90 provided in the shroud 50 and configured to rotationally drive one of the first propeller 10A and the second propeller 10B; and an inner periphery driving motor 150 provided in the shaft portion 3 and configured to rotationally drive another of the first propeller 10A and the second propeller 10B.

With such a configuration, only one of the pair of motors that rotate the first propeller 10A and the second propeller 10B is disposed in the shroud 50. Thus, compared to a case where both the pair of motors are disposed in the shroud 50, the shroud 50 can be downsized.

(2) A fluid machine according to a second aspect is the fluid machine according to (1), in which the outer periphery driving motor 90 is configured to rotationally drive the first propeller 10A, and the inner periphery driving motor 150 is configured to rotationally drive the second propeller 10B.

With the outer periphery driving of the first propeller 10A on the upstream side and the inner periphery driving of the second propeller 10B on the downstream side implemented, the shroud 50 can be downsized.

(3) A fluid machine according to a third aspect is the fluid machine according to (2), further including a rotor shaft 45 extending along the axis O so as to penetrate the first propeller 10A inside the shaft portion 3, the rotor shaft 45 being rotatable around the axis O, an inner circumference portion of the second propeller being fixed to the rotor shaft 45, in which the inner periphery driving motor 150 is provided on the upstream side of the first propeller 10A in the shaft portion 3 and configured to rotationally drive the second propeller 10B via the rotor shaft 45.

Thus, the inner periphery driving motor 150 that drives the second propeller 10B located on the downstream side can be disposed in a portion in the shaft portion 3 on the upstream side. This improves the degree of arrangement.

(4) A fluid machine according to a fourth aspect is the fluid machine according to any one of (1) to (3), in which rotational directions of the first propeller 10A and the second propeller 10B are opposite to each other.

With the use of contra-rotating propellers in which the rotational directions of the first propeller 10A on the upstream side and the second propeller 10B on the downstream side are inverted, the swirling flow generated by the first propeller 10A can be collected by the second propeller 10B. Thus, the swirling loss at the slipstream of the second propeller 10B can be reduced.

In employing contra-rotating propellers, separate driving sources need to be provided in order to make the rotational directions of the first propeller 10A and the second propeller 10B opposite to each other. Even in this case, by disposing only one driving source in the shroud 50 as the outer periphery driving motor 90, the shroud 50 can be downsized.

(5) A fluid machine according to a fifth aspect is the fluid machine according to any one of (1) to (4), in which the shroud 50 has a cross-sectional shape orthogonal to the axis O being of a blade form with an end portion on the upstream side corresponding to a leading edge and an end portion on the downstream side corresponding to a trailing edge.

The cross-sectional shape of the shroud 50 is of a blade form, whereby drag due to a flow of water can be reduced when the fluid machine is disposed underwater. A shape is achieved that conforms to the flow direction of the fluid pumped by the first propeller 10A and the second propeller 10B, whereby the pump efficiency can be further improved.

On the other hand, in order to maintain the blade form while accommodating the plurality of motors inside, the shape of the shroud 50 may need to be upsized more than required to conform to the arrangement structure of the plurality of motors. In view of this, in the configuration of the present aspect, only one of the two motors is disposed in the shroud 50, whereby the size of the shroud 50 can be reduced.

(6) A fluid machine according to a sixth aspect is the fluid machine according to any one of (1) to (5), in which the outer periphery driving motor 90 includes a stator fixed to the shroud 50 and a rotor fixed to an outer circumference portion of one of the first propeller 10A and the second propeller 10B inward in a radial direction of the stator, and the outer periphery driving motor 90 is a conical motor with the stator and the rotor having a diameter decreasing toward the downstream side.

By employing the conical motor with the rotor and the stator having a diameter decreasing toward the downstream side as the outer periphery driving motor 90, the shape of the outer periphery driving motor 90 can conform to the shape of the shroud 50. Thus, the shape of the shroud 50 does not need to be upsized to conform to the configuration of the motor, whereby a compact configuration can be achieved.

(7) A fluid machine according to a seventh aspect is the fluid machine according to any one of (1) to (6), in which one of the first propeller 10A and the second propeller 10B rotationally driven by the outer periphery driving motor 90 includes an inner circumference ring fitted with a clearance on an outer circumference side of the shaft portion 3, and the fluid machine further includes a thrust bearing fixed to the shaft portion 3 and facing the upstream side of the inner circumference ring entirely over a circumferential direction, and a strut 78 supporting the shroud 50 with respect to the shaft portion 3.

When the propeller is rotating, a load is applied on the propeller itself toward the upstream side as a reaction force produced by pumping of a fluid. The load on the propeller is supported by the thrust bearing. When the outer periphery driving motor 90 as the conical motor is driven, electromagnetic force is generated in the conical rotor 130 outward in the radial direction and toward the downstream side. Thus, on the conical rotor 130, force to pull it toward the downstream side acts. As a result, the load applied to the thrust bearing from the propeller is reduced, whereby the thrust load can be reduced.

(8) A fluid machine according to an eighth aspect is the fluid machine according to any one of (1) to (7), in which the shroud 50 includes a plurality of segments split into a plurality of pieces in the axis O direction, and the fluid machine further includes a coupling portion 70 configured to couple the plurality of segments in the axis O direction.

By decoupling the coupling portion 70, the shroud 50 can be separated into a plurality of segments. This makes it easy to attach the rotor and the stator of the motors in the shroud 50.

(9) A fluid machine according to a ninth aspect is the fluid machine according to (8), in which the coupling portion 70 has a convex curved shape protruding from an outside surface of the shroud 50, and has a cross-sectional shape along the outside surface of the shroud 50 being of a blade form with the upstream side corresponding to a leading edge and the downstream side corresponding to a trailing edge.

Thus, drag due to the coupling portion 70 can be suppressed when water is flowing on the outside surface of the shroud 50.

(10) A fluid machine according to a tenth aspect is the fluid machine according to (8) or (9), in which the outer periphery driving motor 90 is fixed only to the segment on the downstream side out of a pair of the segments adjacent to each other in the axis O direction.

The force toward the downstream side, which is a component of the electromagnetic force, acts on the conical rotor 130, whereas the force toward the upstream side, which is a component of the electromagnetic force, acts on the conical stator 100, which is paired with the conical rotor 130. Thus, the force toward the upstream side also acts on the segment on the downstream side, to which the conical stator 100 is integrally attached. As a result, the segment on the downstream side is pressed against the segment on the upstream side by the force. Thus, the segments on the upstream side and the downstream side can be more rigidly fixed and integrated to each other.

(11) An underwater vehicle 1 according to an eleventh aspect includes: a vehicle body 2; and a propulsion apparatus 8 provided to the vehicle body 2, in which the propulsion apparatus 8 is the fluid machine described in any one of (1) to (10).

With such an underwater vehicle 1, the propulsion apparatus 8 can be downsized.

While preferred embodiments of the invention have been described as above, it is to be understood that variations and modifications will be apparent to those skilled in the art without departing from the scope and spirit of the invention.

The scope of the invention, therefore, is to be determined solely by the following claims.

The invention claimed is:

1. A fluid machine comprising:

a shaft portion extending along an axis in an axial direction;

a shroud provided to surround the shaft portion, and forming a flow path between the shroud and the shaft portion, the flow path having one side in the axial direction serving as an upstream side and another side in the axial direction serving as a downstream side;

a first propeller provided rotatably around the axis in the flow path;

a second propeller provided rotatably around the axis on the downstream side of the first propeller in the flow path;

an outer periphery driving motor provided in the shroud and configured to rotationally drive the first propeller;

an inner periphery driving motor provided in the shaft portion and configured to rotationally drive the second propeller; and a rotor shaft extending along the axis so as to penetrate the first propeller inside the shaft portion, the rotor shaft being rotatable around the axis, an inner circumference portion of the second propeller being fixed to the rotor shaft, wherein the shaft portion has a shaft front portion and a shaft rear portion, which is disposed on the downstream side of the shaft front portion in the axial direction with a space between the shaft front portion and the shaft rear portion, wherein the inner periphery driving motor is provided in the shaft front portion on the upstream side of the first propeller and the inner periphery driving motor is configured to rotationally drive the second propeller via the rotor shaft, wherein the rotor shaft protrudes from the shaft front portion such that an end portion of the rotor shaft on the downstream side is in the space between the shaft front portion and the shaft rear portion, and wherein the second propeller is fixed to an outside surface of the end portion of the rotor shaft in the space between the shaft front portion and the shaft rear portion.

2. The fluid machine according to claim 1, wherein rotational directions of the first propeller and the second propeller are opposite to each other.

3. The fluid machine according to claim 1, wherein the shroud has a cross-sectional shape orthogonal to the axis being of a blade form with an end portion on the upstream side corresponding to a leading edge and an end portion on the downstream side corresponding to a trailing edge.

4. The fluid machine according to claim 1, wherein the outer periphery driving motor includes a stator fixed to the shroud and a rotor fixed to an outer circumference portion of the first propeller inward in a radial direction of the stator, and the outer periphery driving motor is a conical motor with the stator and the rotor having a diameter decreasing toward the downstream side.

5. The fluid machine according to claim 1, wherein the first propeller rotationally driven by the outer periphery driving motor includes an inner circumference ring fitted with a clearance on an outer circumference side of the shaft portion, and the fluid machine further comprises a thrust bearing fixed to the shaft portion and facing the upstream side of the inner circumference ring entirely over a circumferential direction, and a strut supporting the shroud with respect to the shaft portion.

6. A fluid machine comprising:

a shaft portion extending along an axis in an axial direction;

a shroud provided to surround the shaft portion, and forming a flow path between the shroud and the shaft portion, the flow path having one side in the axial direction serving as an upstream side and another side in the axial direction serving as a downstream side;

a first propeller provided rotatably around the axis in the flow path;

a second propeller provided rotatably around the axis on the downstream side of the first propeller in the flow path;

an outer periphery driving motor provided in the shroud and configured to rotationally drive one of the first propeller and the second propeller; and an inner periphery driving motor provided in the shaft portion and configured to rotationally drive one of the first propeller and the second propeller, wherein the shroud includes a plurality of segments split into a plurality of pieces in the axial direction, and the fluid machine further comprises a coupling portion configured to couple the plurality of segments in the axial direction.

7. The fluid machine according to claim 6, wherein the coupling portion has a convex curved shape protruding from an outside surface of the shroud, and a cross-sectional shape along the outside surface of the shroud being of a blade form with the upstream side corresponding to a leading edge and the downstream side corresponding to a trailing edge.

8. The fluid machine according to claim 6, wherein the outer periphery driving motor is fixed only to the segment on the downstream side out of a pair of the segments adjacent to each other in the axis direction.

9. An underwater vehicle comprising:

a vehicle body; and a propulsion apparatus provided to the vehicle body, wherein the propulsion apparatus is the fluid machine according to claim 1.

* * * * *